US009810256B2

(12) United States Patent
Blizzard et al.

(10) Patent No.: US 9,810,256 B2
(45) Date of Patent: Nov. 7, 2017

(54) LOCK RING

(71) Applicant: Thundershirt, LLC, Durham, NC (US)

(72) Inventors: Philip J. Blizzard, Durham, NC (US); Michael Creighton, Hatboro, PA (US)

(73) Assignee: Thundershirt, LLC, Durham, NC (US)

( * ) Notice: Subject to any disclaimer, the term of this patent is extended or adjusted under 35 U.S.C. 154(b) by 0 days.

(21) Appl. No.: 15/357,743

(22) Filed: Nov. 21, 2016

(65) Prior Publication Data

US 2017/0146052 A1 May 25, 2017

Related U.S. Application Data

(60) Provisional application No. 62/257,448, filed on Nov. 19, 2015, provisional application No. 62/364,921, filed on Jul. 21, 2016.

(51) Int. Cl.
*F16B 45/04* (2006.01)
*A44B 15/00* (2006.01)

(52) U.S. Cl.
CPC ..... *F16B 45/04* (2013.01); *A44B 15/00* (2013.01)

(58) Field of Classification Search
CPC ..... F16B 45/04; A44B 15/00
See application file for complete search history.

(56) References Cited

U.S. PATENT DOCUMENTS 1,034,630 A * 8/1912 Laun ..... A47H 13/04 16/87.2
1,209,083 A * 12/1916 Wagner ..... A01K 15/003 119/866
2,611,251 A * 9/1952 Guth ..... A44C 7/004 63/14.8
2,983,980 A * 5/1961 Hamel ..... A22B 7/002 224/255
4,308,637 A * 1/1982 Kucera ..... A47H 13/02 16/93 D
5,367,742 A * 11/1994 Bindman ..... A47H 13/02 16/87.2
6,088,885 A * 7/2000 Galbreath ..... A44B 11/04 24/265 AL
6,618,908 B1 * 9/2003 Lamb ..... A44B 5/02 24/114.11
7,523,963 B2 4/2009 Draper et al.
8,366,368 B2 2/2013 Sundholm et al.
9,457,882 B1 * 10/2016 Schueller ..... B63H 20/06

* cited by examiner

*Primary Examiner* — David Upchurch

(74) *Attorney, Agent, or Firm* — Michael G. Johnston; Moore & Van Allen PLLC

(57) ABSTRACT

A lock ring includes an elongated body including an end having a male portion, including a tip having a transverse cross-section larger in diameter than an adjacent portion of the lock ring body. Another end of the body includes a female portion including a tip having a transverse cross-section larger in diameter than the tip of the male portion of the body. The tip of the female portion defines a groove open to the exterior of the tip of the female portion. The groove is configured for receiving the tip of the male portion of the body, wherein the ends of the body are in a connected position. A cover is configured for closing the groove in the tip of the female portion of the body for securing the male portion of the body in the female portion in the connected position.

10 Claims, 6 Drawing Sheets

LOCK RING

CROSS-REFERENCES

This application is related to U.S. provisional application No. 62/257,448, filed Nov. 19, 2015, entitled "LOCK RING", naming Philip J. Blizzard and Michael Creighton as the inventors, and to U.S. provisional application No. 62/364,921, filed Jul. 21, 2016, entitled "LOCK RING", naming Philip J. Blizzard as the inventor. The contents of the provisional applications are incorporated herein by reference in their entirety, and the benefit of the filing dates of the provisional applications is hereby claimed for all purposes that are legally served by such claim for the benefit of the filing date.

BACKGROUND

A lock ring assembly is described and, more particularly, a lock ring assembly for securely maintaining the lock ring in a locked condition, while providing a detachable coupling for moving the lock ring to an open condition.

A conventional metal split-ring is used for all types of applications, most commonly keys, dog tags, or little knick-knacks attached to backpacks. Metal split-rings are inexpensive to produce and very durable. The problem is that they are relatively difficult to use, as it can be hard and frustrating to get the split-ring open enough to accept an item like a dog tag or key, resulting in broken finger nails or even unintentionally jabbing oneself with a screw driver or other small tool used to pry open the rings ends. For dog tags, the difficulty of dealing with metal split-rings often results in owners delaying or failing to place updated rabies tags or identification tags on their dogs. The owner receives the tags and then throws them into a drawer to "deal with it later", but "later" often never comes.

For the foregoing reasons, there is a need for a new lock ring as an alternative to the conventional metal split-ring.

SUMMARY

A lock ring is described comprising an elongated body. The body includes an end comprising a male portion, including a tip having a transverse cross-section larger in diameter than an adjacent portion of the lock ring body. Another end of the body comprises a female portion including a tip having a transverse cross-section larger in diameter than the tip of the male portion of the body. The tip of the female portion defines a groove open to the exterior of the tip of the female portion. The groove is configured for receiving the tip of the male portion of the body, wherein the ends of the body are in a connected position. A cover is configured for closing the groove in the tip of the female portion of the body for securing the male portion of the body in the female portion in the connected position.

BRIEF DESCRIPTION OF THE DRAWINGS

For a more complete understanding of the lock ring assembly, reference should now be had to the embodiments shown in the accompanying drawings and described below. In the drawings.

DESCRIPTION

Figure 1:
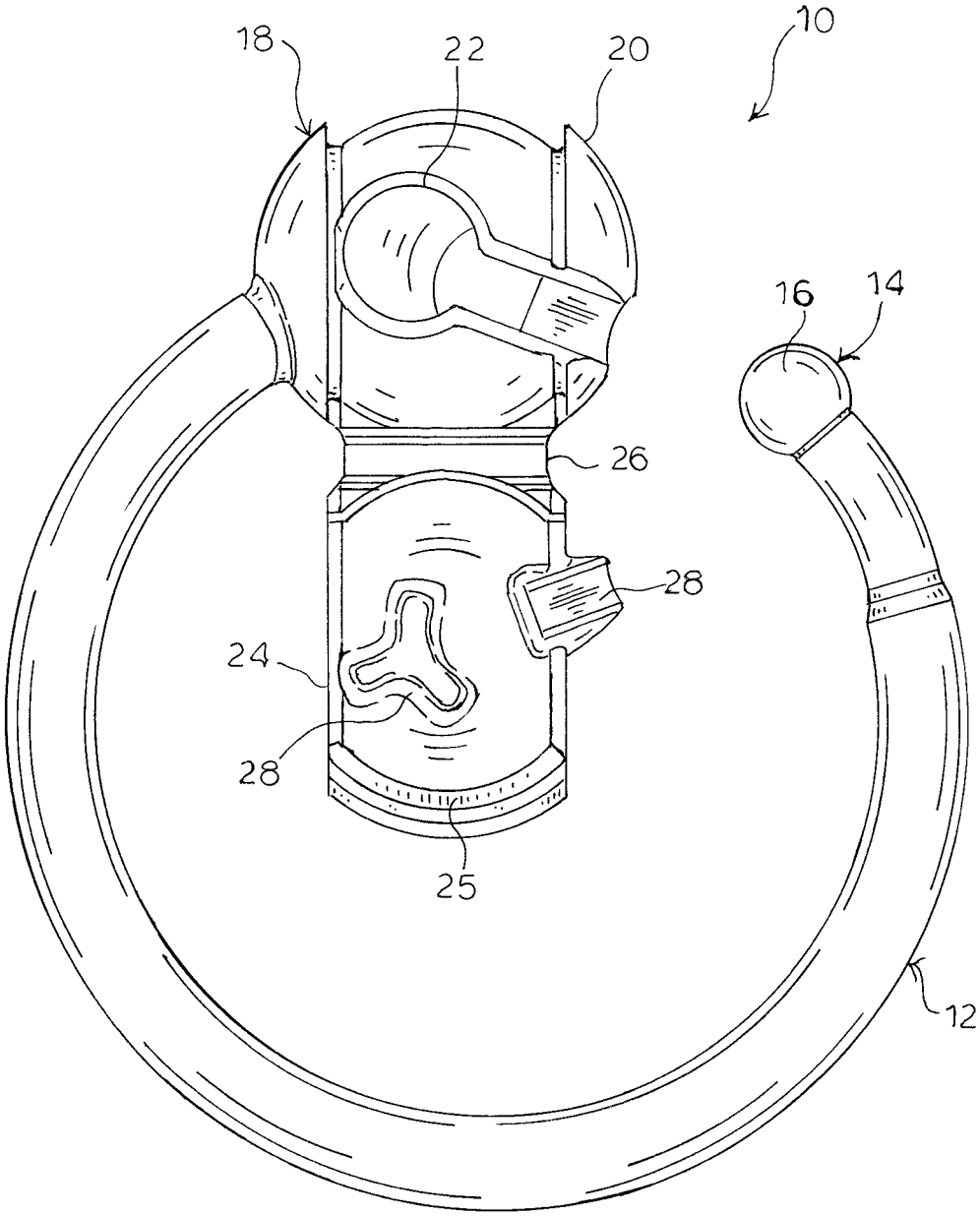
FIG. 1 is a front elevation view of an embodiment of a lock ring assembly in a first position.

Certain terminology is used herein for convenience only and is not to be taken as a limiting. For example, words such as "upper," "lower," "left," "right," "horizontal," "vertical," "upward," "downward," "top" and "bottom" merely describe the configurations shown in the FIGs. Indeed, the components may be oriented in any direction and the terminology, therefore, should be understood as encompassing such variations unless specified otherwise. The words "interior" and "exterior" refer to directions toward and away from, respectively, the geometric center of the core and designated parts thereof. The terminology includes the words specifically mentioned above, derivatives thereof and words of similar import.

A lock ring assembly is shown and described and generally designated at 10. The lock ring assembly 10 comprises a generally annular body 12. One free end of the body 12 of the lock ring includes a male portion 14 having a tip 16. The tip 16 of the male portion 14 is generally circular in transverse cross-section and has a larger diameter than the adjacent portion of the lock ring body 12. The other free end of the body 12 of the lock ring comprises a female portion 18 also having a tip 20 that is generally circular in transverse cross-section. The tip 20 of the female portion 18 has a larger diameter than the tip 16 of the male portion 14 of the lock ring body 12.

The tip 20 of the female end portion 18 of the lock ring body 12 defines a locking groove 22 open at one end to the exterior of the tip 20. The groove 22 is configured for receiving the tip 16 of the male end portion 14 of the lock ring body 12. The groove 22 closely accommodates the tip 16 of the male portion 14 as well as a length of the adjacent smaller diameter lock ring body 12. As a result, the male end portion 14 of the lock ring body 12 "snaps" into place in the groove 22 in the female end portion 14. In one embodiment, the lock ring body 12 is then pulled axially such that the tip 16 of the male end portion 14 "snaps" into the female end portion 18. The ends of the lock ring body 12 are thus maintained in a connected condition.

The lock ring assembly 10 includes a cover 24 for closing the groove 22 in the female portion 18 of the lock ring body 12 for securing the male portion 14 of the lock body 12 in the female portion 18. The cover 24 is configured for engaging the spherical tip 20 of the female portion 18 in a closed position. In one embodiment, the tip 20 of the female portion 18 defines a recess corresponding to the shape of the cover 24 for receiving the cover 24. The cover 24 is connected to the female portion 18 of the lock ring body 12 by a hinge 26. The cover 24 pivots on the hinge 26 between an open position and the closed position.

Figure 2:
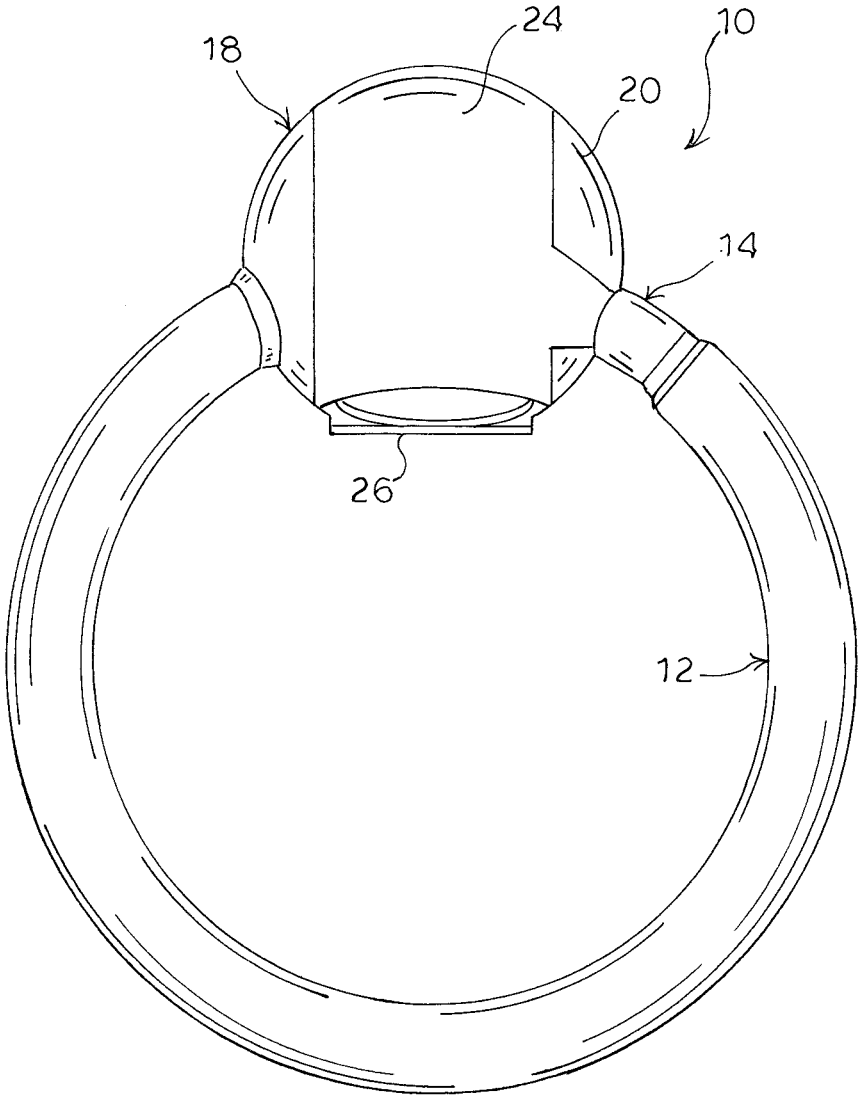
FIG. 2 is a front elevation view of the lock ring assembly as shown in FIG. 1 in a second position.
Figure 3:
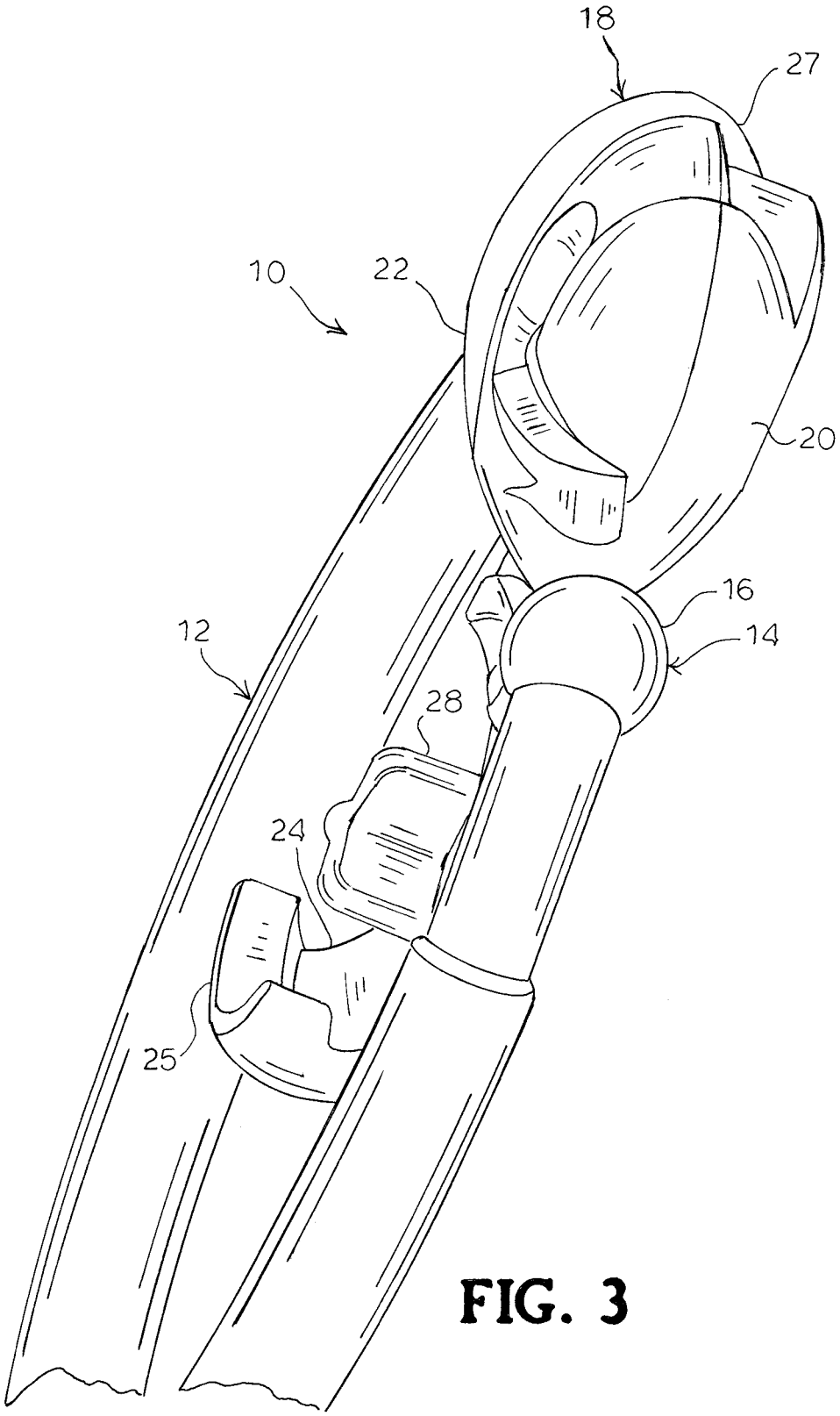
FIG. 3 is a side perspective view of the lock ring assembly as shown in FIG. 1.

A pair of protrusions 28 extends inwardly from the inner surface of the cover 24. The protrusions 28 are sized and positioned for being received in the 22 groove when the cover is in the closed position. The protrusions 28 extend between and frictionally engage the walls of the spherical tip 20 of the female portion 18 defining the groove 22 for aligning the cover in the closed position as shown in FIG. 2. The protrusions 28 extend into the groove for engaging and fixing the male end portion 14 of the lock ring body 12 in the groove 22. As best seen in FIG. 3, the peripheral edge of the cover 24 has an inwardly projecting lip 25 and the peripheral edge of the tip 20 of the female end portion 18 has material removed forming a corresponding shoulder 27. In the closed position, the lip 25 snaps over the shoulder 27 for securing the cover 24 to the female end portion 18 of the lock ring body 12.

The lock ring assembly 10 can be made from a durable, flexible plastic such as a homo-polymer polypropylene. The plastic embodiment may be molded as a single piece employing a "living hinge" 26 for the pivoting cover 24. Other suitable materials include neoprene or other rubber and metals, such as aluminum. It is understood that the size of the lock ring assembly 10 can vary from very small to the very large. It is further understood that the respective tips 16, 20 of the male end portion 14 and the female end portion 18 of the lock ring body 12 may be a shape other than as shown in the FIGs., as long as their size relative to the lock ring body 12 and to one another is maintained.

In use, when the male end portion 14 and the female end portion 18 of the lock ring body 12 are not connected, the lock ring body 12 can be flexed to allow for adding items onto the lock ring or for placing the ring onto another ring, loop or other attachment point. Next, the tip 16 of the male end portion 14 of the lock assembly 10 is positioned in the groove 22 of the female end portion 18 for closing the annular loop of the lock ring body 12. Once the male end portion 14 is positioned and snapped into the female end portion 18, the cover 24 is snapped onto the tip 20 of the female end portion 18 and for closing the groove 22. The ends of the lock ring assembly 10 are thus prevented from disconnecting from this very secure connection to minimize the risk of unintentional opening of the lock ring and the loss of the tags, keys or other items on the ring. Moreover, the cover 24 over the groove 22 of the female end portion 18 provides the user with visible assurance that the coupled end portions 14, 18 are locked together. To release the cover 24, the user flexes the cover 24 to disengage the lip 25 from the shoulder 27. The male end portion 14 is then removable from the groove 22 for returning the lock ring assembly 10 to the open position.

Figure 4:
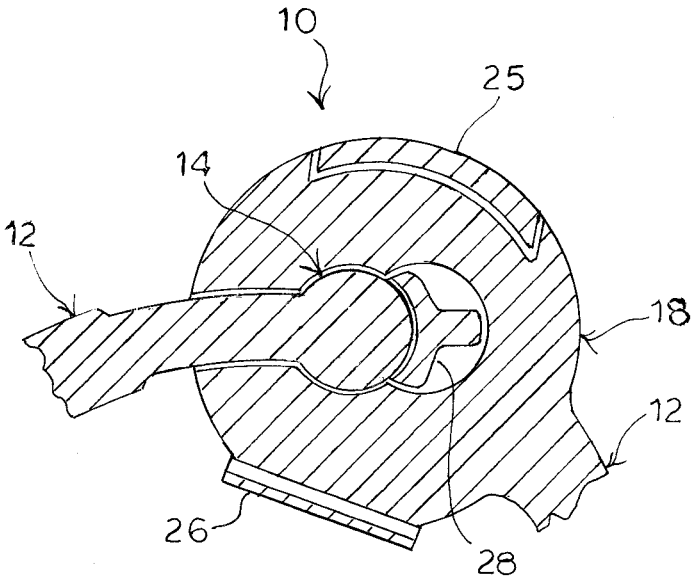
FIG. 4 is a cross-section of a portion of the lock ring assembly as shown in FIG. 2.
Figure 7:
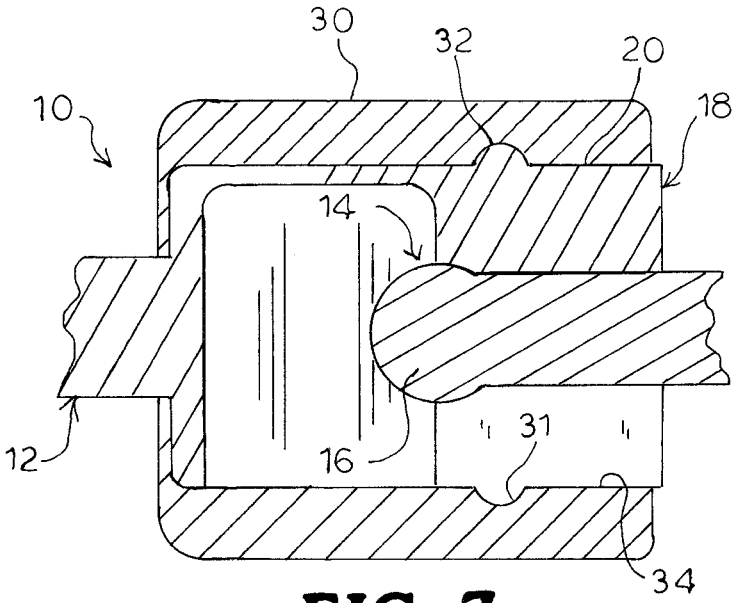
FIG. 7 is a cross-section of a portion of the lock ring assembly as shown in FIG. 7.
Figure 5:
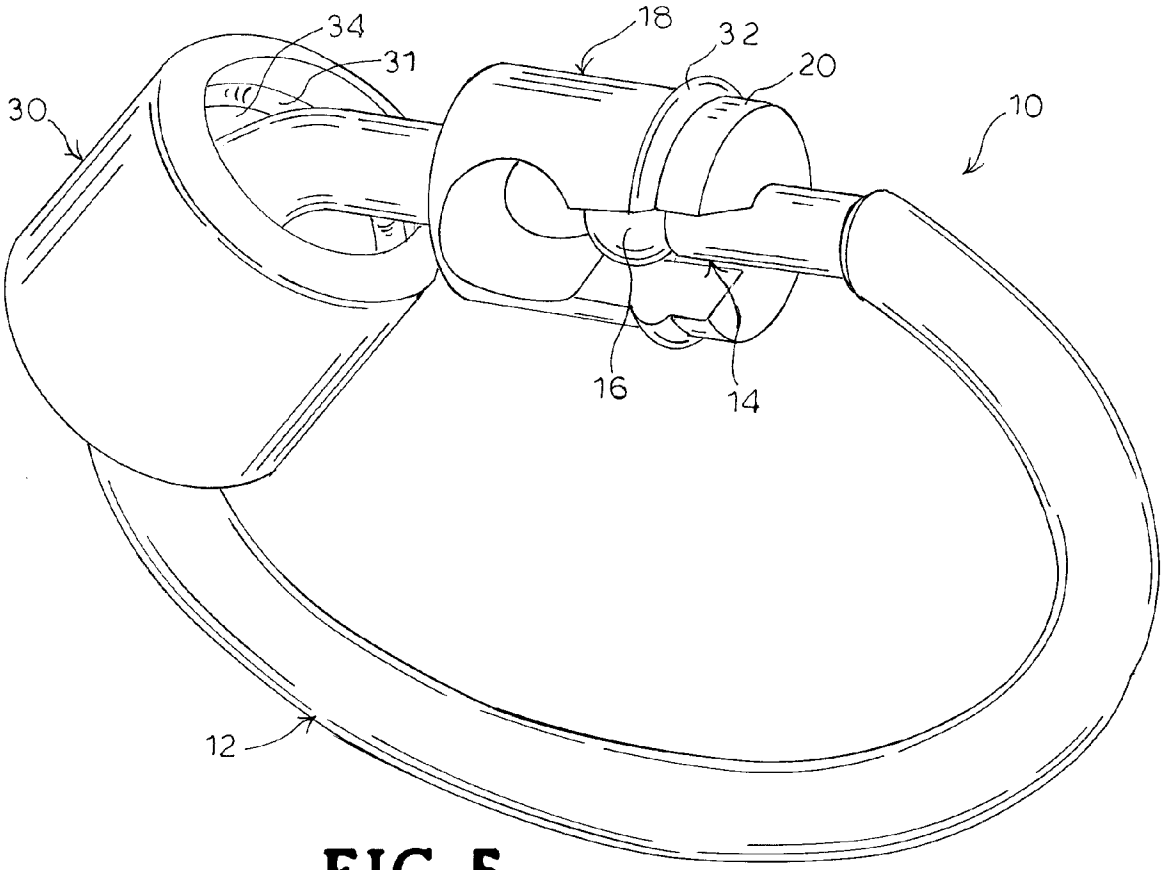
FIG. 5 is a front elevation view of another embodiment of a lock ring assembly in a first position.
Figure 6:
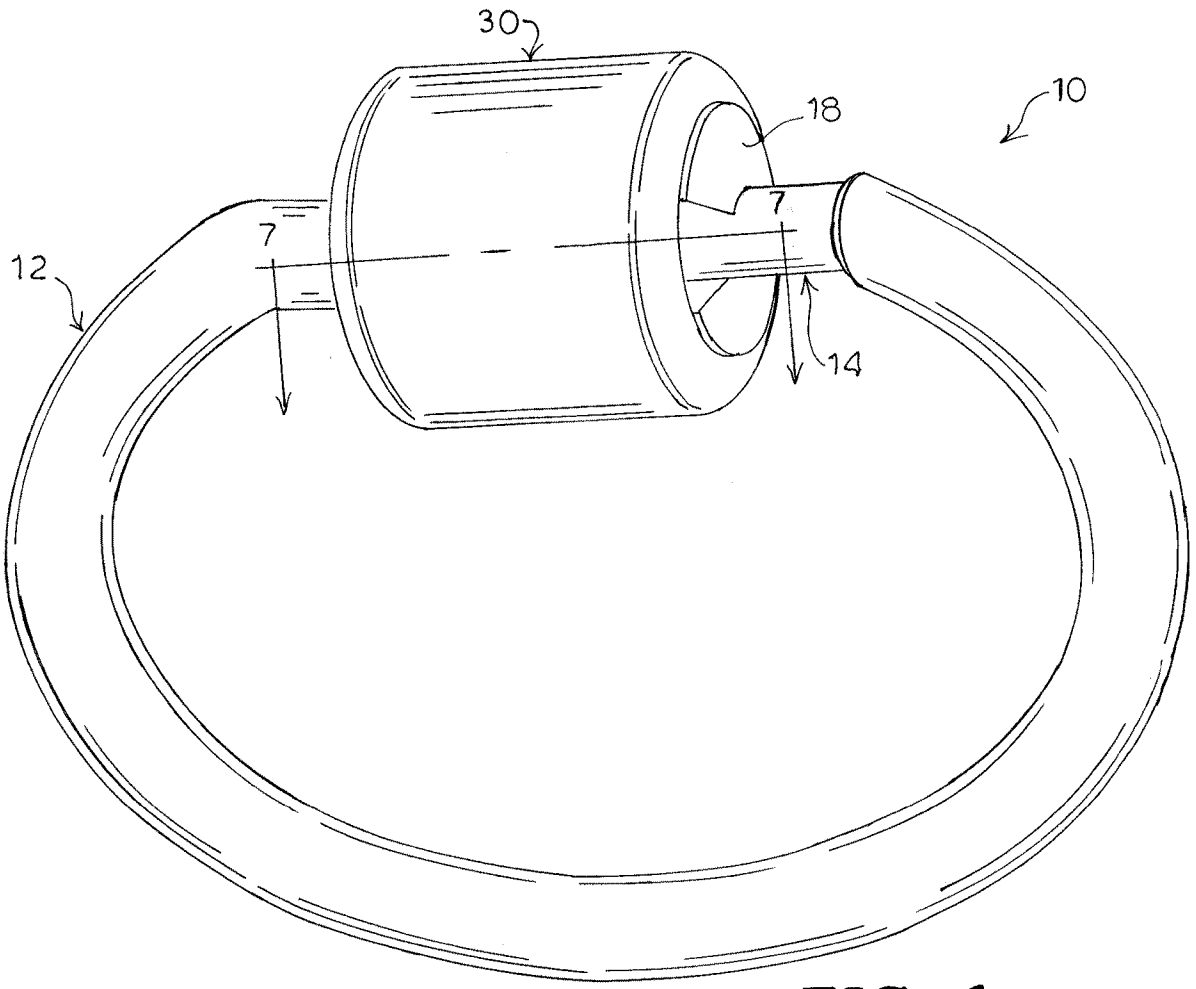
FIG. 6 is a front elevation view of the lock ring assembly as shown in FIG. 5 in a second position.

Another embodiment of a cover for the lock ring assembly is shown in FIGS. 4 and 5 and generally designated at 30. The cover 30 comprises a generally cylindrical hollow cylinder open at both ends. The opening 31 through the cover 30 is configured such that the cover 30 may be manually forced past the tip 16 of the male portion 14 of the body 12. The cover 30 thus is slidable along the body 12 and will not slide past the tip 16 without force when the lock ring assembly 10 is in the open condition. The tip 18 of the female portion 18 of the body 12 in this embodiment is also generally circular in transverse cross-section corresponding to the interior of the cover 30.

In use, the interface and engagement of the male portion 14 of the body 12 and the female portion 18 of the body 12 are the same as in the previous embodiment. Once the male end portion 14 is positioned and securely snapped into the female end portion 18, the cover 30 is slid onto the conjoined male portion 14 and female end portion 18. The female portion 12 includes an annular ridge 32 configured to be received, or snapped, into a corresponding annular slot 34 in the inner surface of the cover 30 for securing the cover 30 in position. In this position, the ends of the cover 30 span the ends of the lock ring assembly 10 in the closed condition preventing disconnection and unintentional opening of the lock ring and the loss of the tags, keys or other items on the ring. To release the cover 30, the user pulls the cover 30 to disengage the ridge 32 from the slot 34. The male end portion 14 is then removable from the groove 22 for returning the lock ring assembly 10 to the open position.

The lock ring assembly 10 has many advantages, including being easy to attach to, or remove from, a d-ring on a dog collar. In addition, metal tags are easy to put on and take off, and there is minimal risk of "unintended" release of the tags. It is understood that the lock ring assembly may be used in various applications and situations other than the embodiment as described and shown herein. The lock ring may be used for anything that needs a ring for connecting or securing items, for example, keys or knick-knacks or when it is desirable to secure a lock.

We claim:

1. A lock ring comprising:
an elongated body, the body including
an end comprising a male portion including a tip having a transverse cross-section larger in diameter than an adjacent portion of the lock ring body, and
another end comprising a female portion including a tip having a transverse cross-section larger in diameter than the tip of the male portion of the body, the tip of the female portion defining a groove open to the exterior of the tip of the female portion, the groove configured for receiving the tip of the male portion of the body, wherein the ends of the body are in a connected position; and
a cover configured for closing the groove in the tip of the female portion of the body for securing the male portion of the body in the female portion in the connected position; and
a hinge connected between the cover and the female portion of the body, wherein the cover pivots on the hinge between an open position and the closed position.

2. The lock ring as recited in claim 1, wherein the tip of the male portion of the body is generally circular in transverse cross-section.

3. The lock ring as recited in claim 1, wherein the tip of the female portion of the body is generally circular in transverse cross-section.

4. The lock ring as recited in claim 1, wherein the tip of the female portion of the body defines a recess corresponding to the periphery of the cover for receiving the cover.

5. A lock ring comprising:
an elongated body, the body including
an end comprising a male portion including a tip having a transverse cross-section larger in diameter than an adjacent portion of the lock ring body, and
another end comprising a female portion including a tip having a transverse cross-section larger in diameter than the tip of the male portion of the body, the tip of the female portion defining a groove open to the exterior of the tip of the female portion, the groove configured for receiving the tip of the male portion of the body, wherein the ends of the body are in a connected position;
a cover configured for closing the groove in the tip of the female portion of the body for securing the male portion of the body in the female portion in the connected position; and
a plurality of protrusions extending inwardly from an inner surface of the cover, wherein the protrusions are configured for being received in the groove when the cover is in the closed position.

6. The lock ring as recited in claim 5, wherein the cover is movably mounted to the female portion of the body.

7. The lock ring as recited in claim 5, wherein the cover comprises a hollow cylinder open at both ends, the cover slidable along the body and configured to slide over the conjoined tip of the male portion and the tip of the female portion, wherein the cover spans the ends of the body for securing the ends in the connected position.

8. The lock ring as recited in claim 5, wherein the tip of the male portion of the body is generally circular in transverse cross-section.

9. The lock ring as recited in claim 5, wherein the tip of the female portion of the body is generally circular in transverse cross-section.

10. The lock ring as recited in claim 5, wherein the tip of the female portion of the body defines a recess corresponding to the periphery of the cover for receiving the cover.

* * * * *